United States Patent [19]

Conti et al.

[11] 3,981,161

[45] Sept. 21, 1976

[54] PANTY HOSE WITH REINFORCED LONGITUDINAL WAIST OPENING

[75] Inventors: Paolo Conti; Massimo Bianchi, both of Florence, Italy

[73] Assignee: Billi, S.p.A., Florence, Italy

[22] Filed: Apr. 12, 1974

[21] Appl. No.: 460,581

[30] Foreign Application Priority Data

Apr. 13, 1973 Italy ..... 9418/73

[52] U.S. Cl. ..... 66/177; 66/134

[51] Int. Cl.[2] ..... A41B 9/08

[58] Field of Search ..... 66/134, 125 R, 172 R, 66/172 E, 175, 176, 177, 145

[56] References Cited

UNITED STATES PATENTS

| | | | |
|---|---|---|---|
| 2,887,860 | 5/1959 | Bellman | 66/172 R |
| 3,159,990 | 12/1964 | Monday | 66/172 E |
| 3,262,288 | 7/1966 | Burd | 66/172 R |
| 3,670,529 | 6/1972 | Fregeolle | 66/177 |
| 3,673,821 | 7/1972 | Johnson | 66/177 |
| 3,748,870 | 7/1973 | Fregeolle | 66/177 |
| 3,815,385 | 6/1974 | Gariboldi | 66/177 |

FOREIGN PATENTS OR APPLICATIONS

| | | | |
|---|---|---|---|
| 2,038,212 | 3/1971 | Germany | 66/177 |
| 1,938,623 | 2/1970 | Germany | 66/177 |
| 2,034,010 | 1/1971 | Germany | 66/177 |

OTHER PUBLICATIONS

Santoni "Thread Through" is the Latest Panti-Hose Development, in the Hosiery Trade Journal, p. 13, Sept. 1972.

*Primary Examiner*—Mervin Stein
*Assistant Examiner*—Andrew M. Falik
*Attorney, Agent, or Firm*—Clifton T. Hunt, Jr.

[57] ABSTRACT

A continuous, tubular, one-piece panty hose is formed on a circular knitting machine with a waist opening extending longitudinally of the direction of knitting and surrounded by a reinforced elastic section with stitches that resist raveling or breakdown. In the waist portion of the panty hose, each course is formed by a pair of partial courses, one end of which overlap and the other end of which form the longitudinal opening.

1 Claim, 25 Drawing Figures

| | | | | | |
|---|---|---|---|---|---|
| K | K | K | K | K | K |
| K | T | T | T | K | T |
| K | K | K | K | K | K |
| K | T | T | T | K | T |
| K | K | K | K | K | K |

FIG. 10

PANTY HOSE WITH REINFORCED LONGITUDINAL WAIST OPENING

BACKGROUND OF THE INVENTION

In the knitting of one-piece panty hose it is known to form the waist opening during the knitting operation as described, for example, in U.S. Pat. No. 3,673,821 to Johnson. The waist opening is defined by a cut or slit extending wale-wise along the knitted fabric, that is in the direction of knitting. Considerable difficulty has been realized, however, because of the tendency of the yarn adjacent the edge of such a longitudinal slit to ravel or breakdown.

SUMMARY OF THE PRESENT INVENTION

The present invention, on the other hand, forms the longitudinal slit during knitting of the panty hose on the machine without the necessity of any special, auxiliary fixtures. Also, an elastic edge or welt is formed integral with the knitting operation which provides an excellent edge finish, as well as prohibiting raveling or breakdown of stitches around the edge.

In accordance with the present invention, first a conventional yarn cutting device used on knitting machines is provided which includes a geared conveyor rotating with the hooks platen or disc and a shearing means for cutting excess lengths of yarn ends as they are removed and reinserted into the fabric. Secondly, the waist portion of the panty hose includes a section comprising a plurality of partial stitch courses extending approximately half-way around the tubular fabric. One end of the partial stitch courses terminates adjacent the longitudinal cut or slit which is being formed and the other end terminates on the back side of the tubular fabric therefrom with alternate partial courses extending around opposite sides of the tubular portion. At the rear or in the secondary position, the partial courses from one side of the tubular fabric are partly superimposed and overlap the partial courses from the other side of the tubular fabric. Thirdly, in the areas adjacent the longitudinal slit, at least some partial courses are provided with a supplementary elastic yarn, and immediately adjacent the longitudinal slit selected stitches in one course are interlaced with stitches of a succeeding course by means of a needle selection which forms a retained stitch to assure the anchoring of the yarns along the cut or slit.

More particularly, in a zone adjacent the longitudinal cut, the partial courses from each part of the slit are formed by alternating a first course comprising a non-elastic yarn with a second course comprising a pair of yarns, one non-elastic and the other elastic. In the zone immediately adjacent the cut edges some stitches are retained and worked in with stitches having elastic yarns in contiguous courses. In the last said zones the fabric tends to roll up and thus enhances the stability of the stitches in the area surrounding the longitudinal cut edges and thus the finish of said cut or slit. In practice, the first mentioned zone farthest from the cut or slit is formed with a plain stitch, while in the zone immediately adjacent the slit the courses which have only the non-elastic yarn are formed by retaining three consecutive stitches on the needles to be picked up by the corresponding needles of the next course, while the fourth stitch is cleared from its needle. In order to reinforce the area adjacent the upper and lower ends of the longitudinal slit or cut, the fabric in this area is formed with all courses having stitches of both non-elastic yarn and elastic yarn.

The invention also relates to the knit construction for the waist portion of a panty hose obtained by the above-defined process.

The invention will be better understood by reading the following description along with the accompanying drawings, which illustrates a practical embodiment, however is not considered to be restrictive of the invention.

Figure 4:
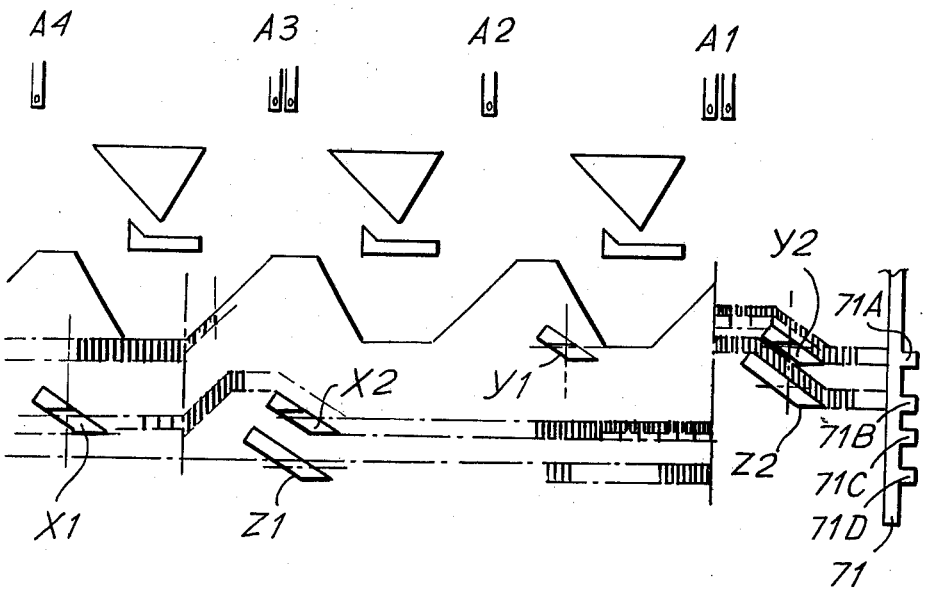
Figure 4A:
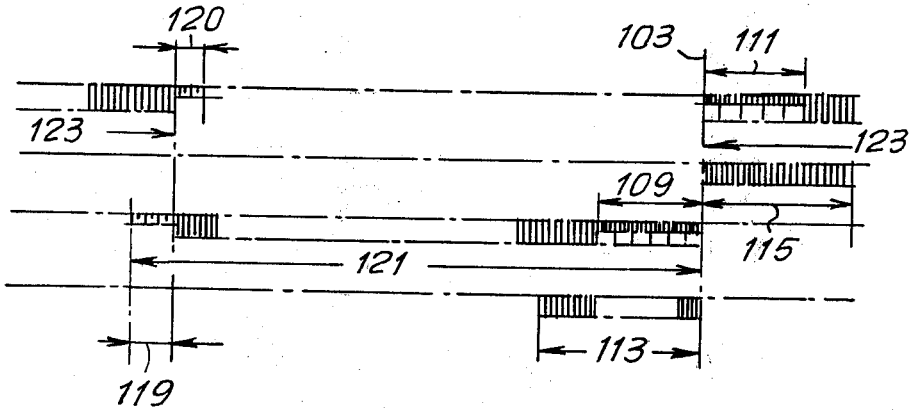
Figure 5:
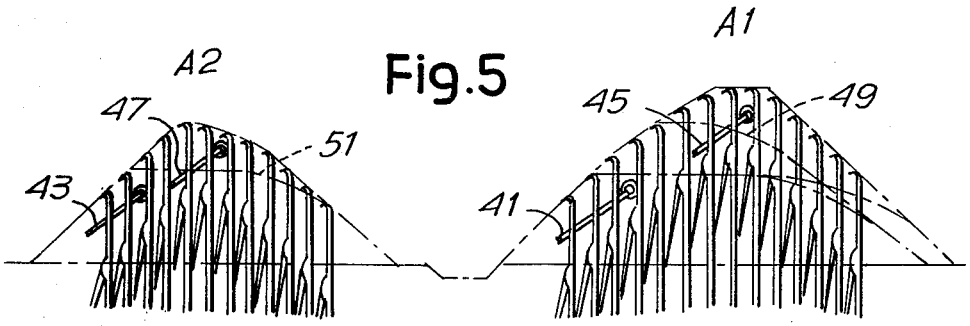
Figure 6:
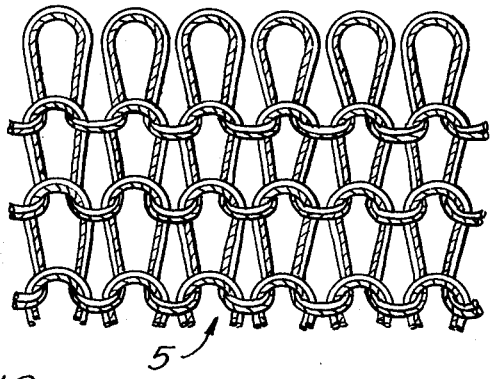
Figure 7:
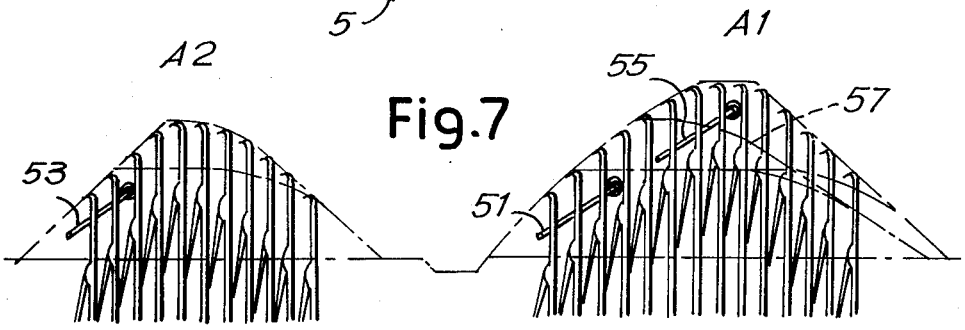
Figure 8:
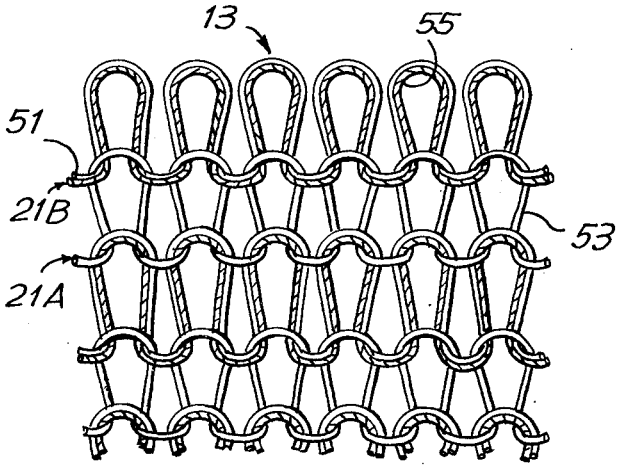
Figure 9:
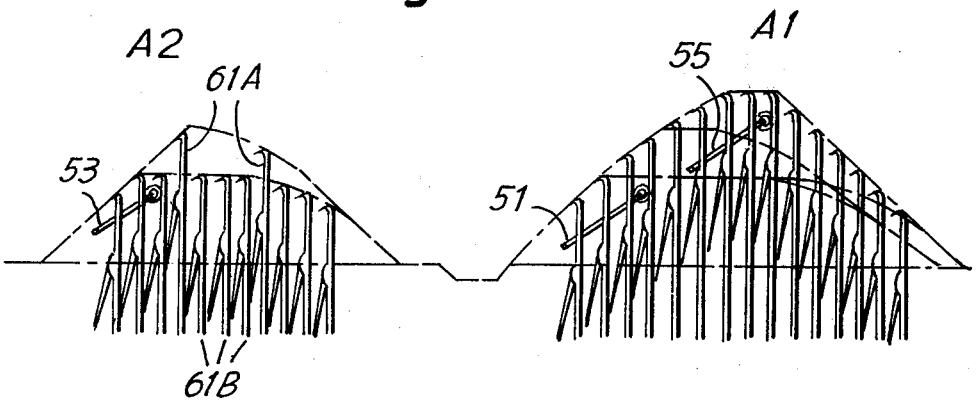
Figure 11:
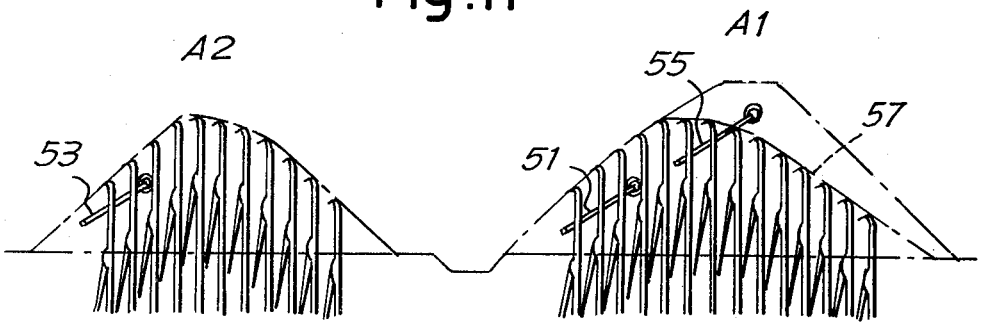
Figure 12:
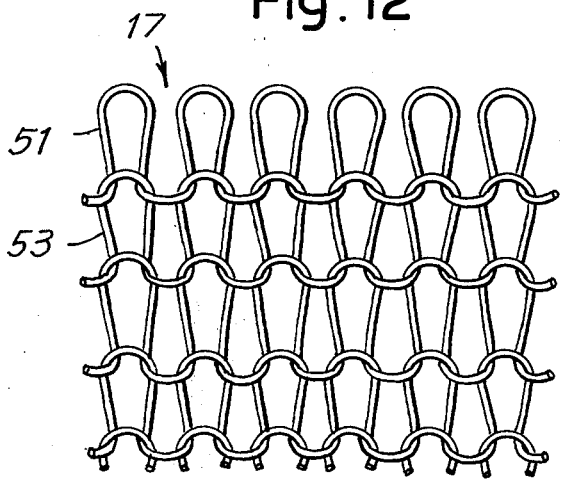

FIGS. 4 and 4A schematically illustrate the cam shell and arrangement of jack butts for controlling the needles in the zone of the longitudinal slit;

FIGS. 5, 7, 9, and 11 illustrate the incoming yarn position and needle path at two consecutive feeds in different portions of the fabric;

FIGS. 6, 8, and 12 are pictorial illustrations of the fabric obtained by the set-ups of FIGS. 5, 7, and 11 respectively;

FIG. 10 is a diagram illustrating the fabric obtained by the set up of FIG. 9;

FIGS. 13–18 schematically illustrate use of a feed machine for forming partial courses of fabric and shearing the ends of the yarn therein in relation to the positioning of the yarn guides, the shearing means, and the suction means which holds the yarn after it is sheared.

FIGS. 20A–20F are similar to FIGS. 13–18 and showing a continuation of the knitting cycle with four feeds.

DETAILED DESCRIPTION OF A PREFERRED EMBODIMENT

Figure 1:
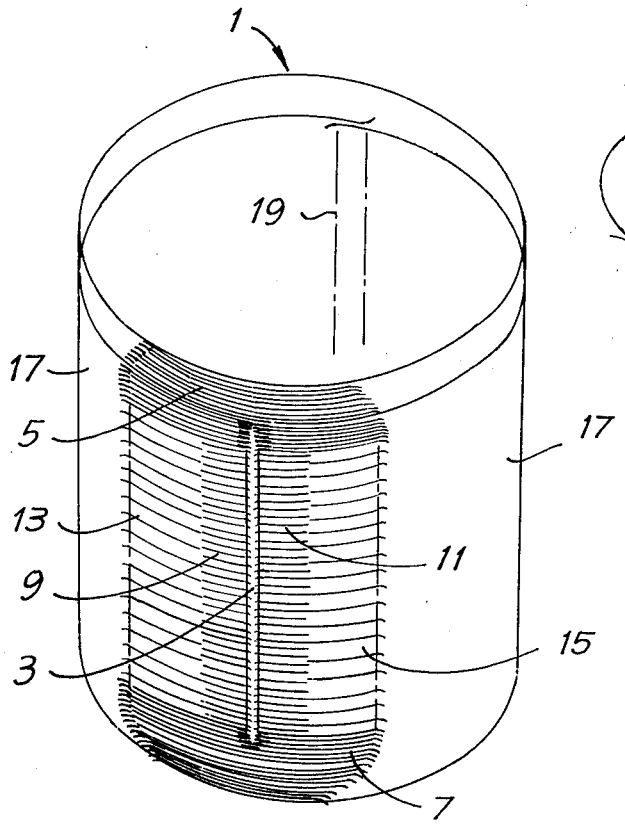
FIG. 1 is a schematic illustration of a portion of a panty hose formed in accordance with the present invention.

Turning now to the drawings, FIG. 1 shows the waist portion 1 of a panty hose in the area in which longitudinal cut or opening 3 is formed during the knitting of the article. The same cutting means used for cutting or shearing yarns upon insertion and removal thereof is used to form the longitudinal opening 3.

In FIG. 1 two zones of fabric 5, 7 are located adjacent the ends of the longitudinal opening 3. Two other inner zones 9, 11 of fabric flank the edges of opening 3, while outer zones 13, 15 flank the inner zone 9, 11. So arranged, zones 5, 7, 9, 11, 13, and 15 form an elastic band surrounding the opening 3 in which an elastic yarn is provided to reinforce as well as thicken the fabric. Outside such a band lies the normal fabric 17 of the tubular article. On the rear side of the waist portion 1, another zone 19 of fabric is illustrated which is approximately opposite opening 3, however it should be realized that this zone 19 could be arcuately spaced from the opening otherwise than immediately opposite thereof. Zone 19 is developed as described more fully and for the reasons stated hereinafter.

Figure 2:
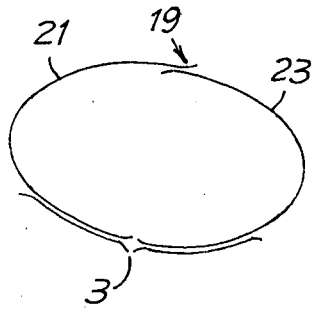
FIG. 2 is a schematic illustration of a course formed with two partial courses.

In the area of the waist portion corresponding to the opening 3 and in the zone 5 and 7 at the ends of the opening, the panty hose is formed with partial courses or semi-courses, rather than with circumferential continuous courses. In FIG. 2 a first semi-course 21 is formed between opening 3 and the zone 19 along a first arc, while a second semi-course 23, extending along an arc corresponding to but opposite to the arc of course 21, is developed between zone 19 and opening 3. The knitted lengths of yarn which constitute semi-courses 21, 23 are sheared or cut at each end thereof by conventional cutting systems provided on machines for cutting yarn as it is introducted and withdrawn at the beginning and end of the working thereof.

In FIGS. 13–18 there are illustrated conventional members provided in the machines for introducing and withdrawing yarns and for shearing and retaining the severed yarn with two feeds knitting. Reference numerals 25 and 27, for example, designate two yarn guides in different feed positions flanked by other yarn guides indicated at 29 and 29A. A fixed plate 31 overlies the dial, said fixed plate being combined in a known manner with a conventional suction inlet 33 to retain the yarn. A shearing or cutting device 35 is carried by the fixed plate 31 and arranged to cut the yarn very near the last stitch which has engaged it or the first stitch which has engaged it. The shearing means may comprise any suitable means, for example, a blade which cooperates like a shear with a stationary ratchet member 36.

Figure 13:
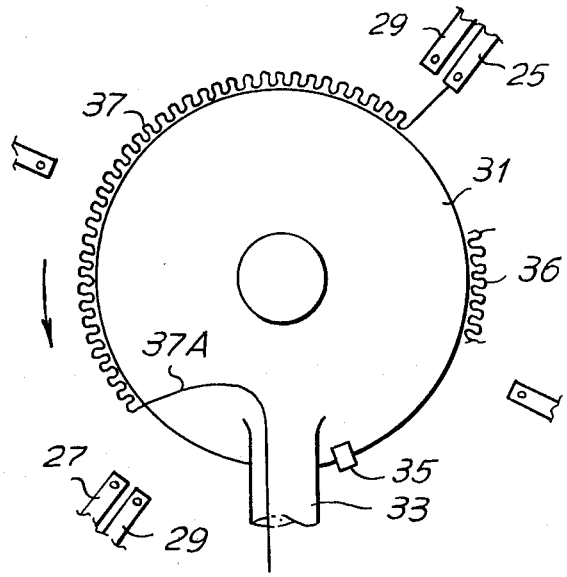
Figure 14:
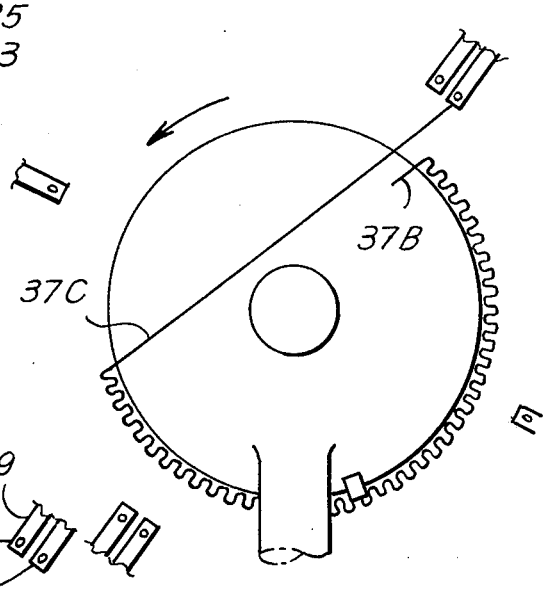
Figure 15:
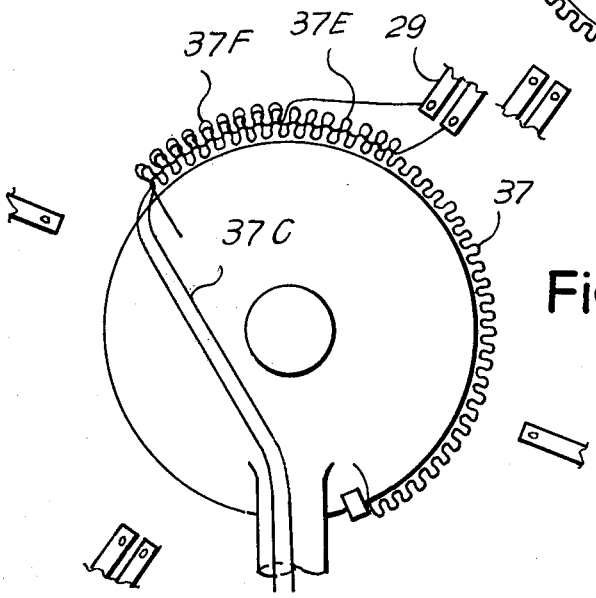
Figure 16:
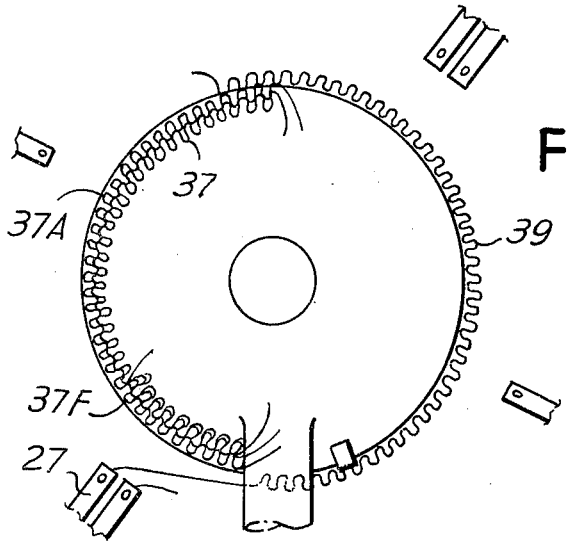
Figure 17:
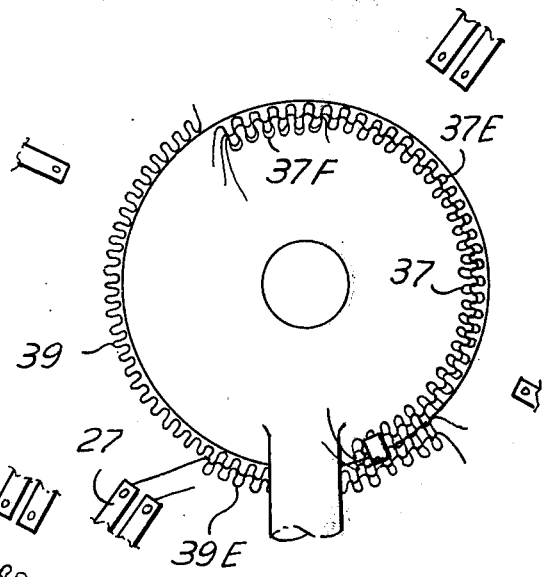
Figure 18:
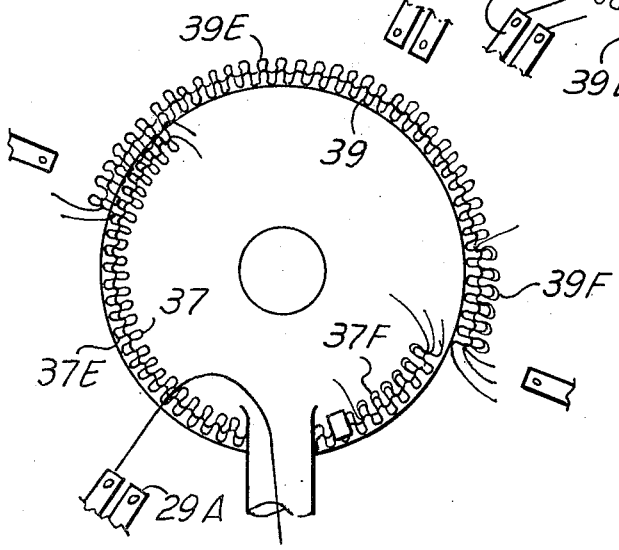

In FIG. 13, there is shown a partial course 37 formed with the yarn of the yarn guide 25, the initial end 37A of the course being held by the suction inlet 33 and being sheared by the means 35 which form a short length 37B, the residual piece being eliminated through the suction inlet 33. At the end of the forming of the course 37, the yarn 37C continues to be unwound, being entrained by the last needle for the forming of the partial course 37 until it assumes the array of FIG. 14 to reach the cutting device 35. The initial end of the yarn 37C after being cut is returned by the suction inlet 37 as shown in FIG. 15 for the forming of a new course. Then there is formed a second course 37E in correspondence of course 37 and with an initial zone 37F in which an elastic yarn is added by yarn guide 29 (see FIG. 15). In FIG. 16 is shown the forming of a partial course 39 with the yarn of yarn guide 27 and using the same suction inlet 33 and the same cutting system 35, 36. FIG. 17 shows the partial course 39 completed and the beginning of a second partial course 39E, still with the yarn of yarn guide 27. FIG. 18 shows the course 39E completed with the end portion 39F including the elastic yarn fed by yarn guide 29. For clarity of illustration, most of the cut yarns retained by the suction inlet 33 have not been shown.

Figure 20A:
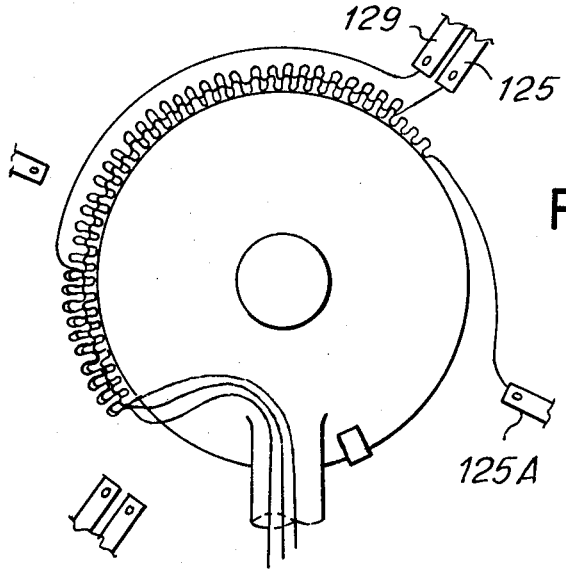
Figure 20B:
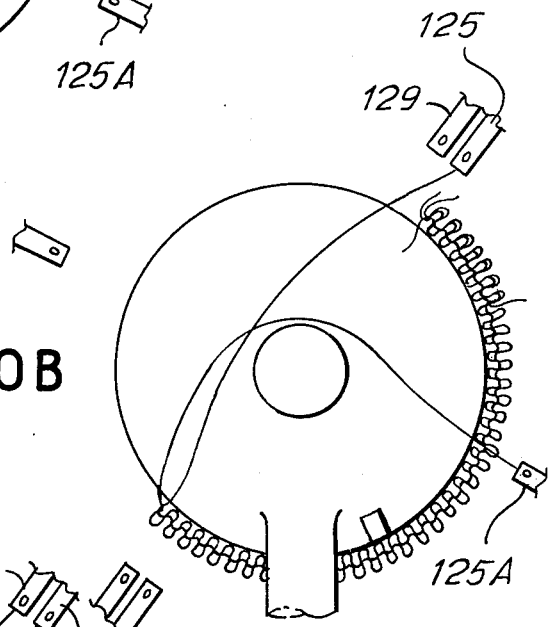
Figure 20C:
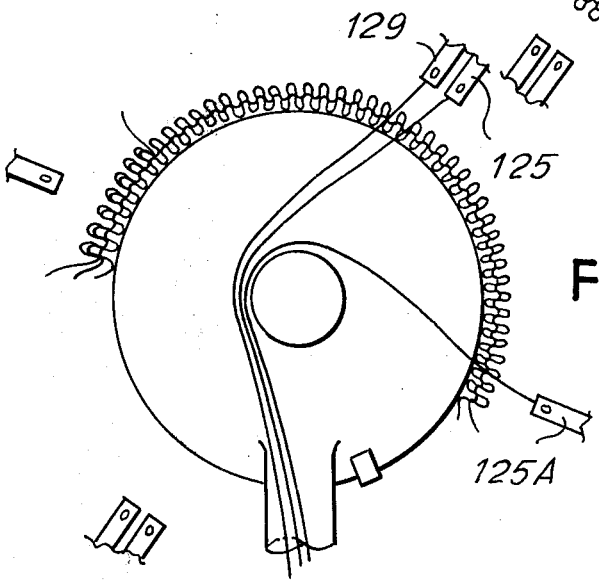
Figure 20D:
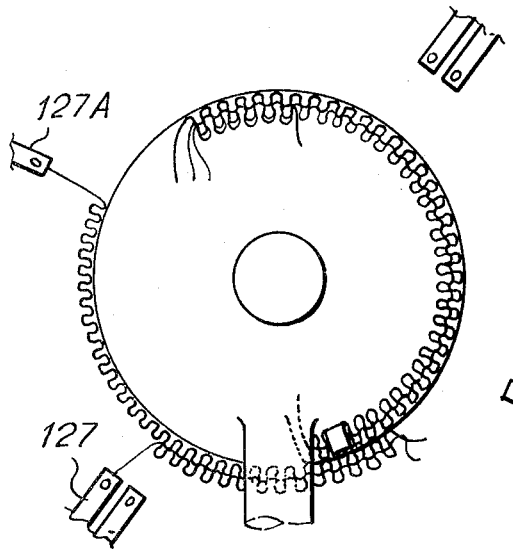
Figure 20E:
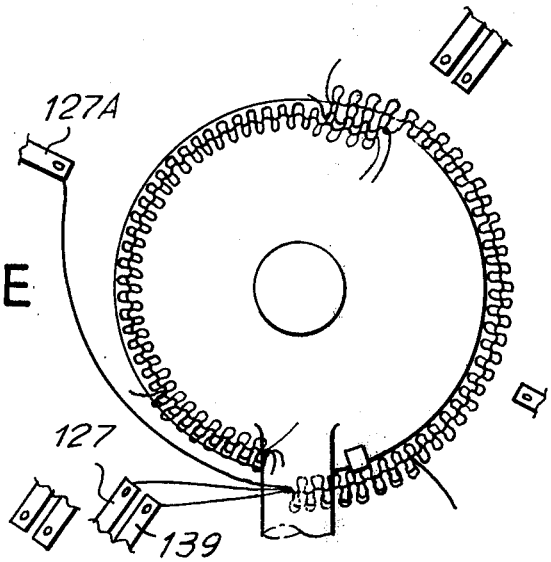
Figure 20F:
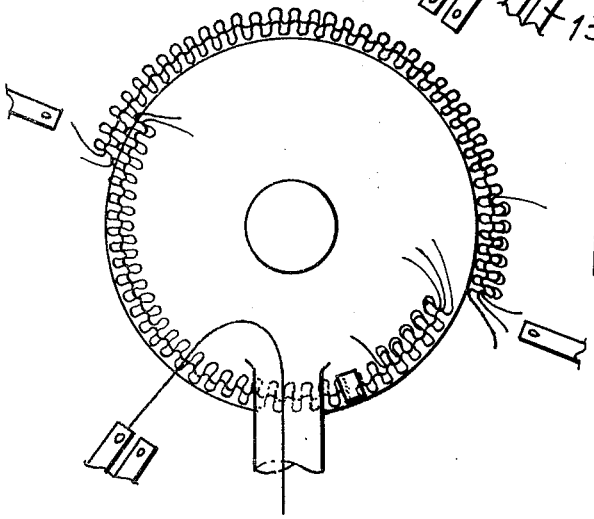

In FIGS. 20A–20F, there is illustrated a continuation of the knitting cycle with four feeds knitting. In FIG. 20A, the first and second courses formed with the feeds 125 and 125A and the elastic course formed with the feed 129 are almost completed. In FIG. 20B, the first and the second course are completed and the yarns are about to be cut, as more clearly appears in FIG. 20C. In FIG. 20D, the third and fourth courses are begun with feeds 127 and 127A. In FIG. 20E the third and fourth courses are nearing completion as is an elastic course taken from feed 139. In FIG. 20F, all of the yarns are cut after the four partial courses, preparatory to beginning the cycle again.

With a knitting machine set-up as described hereinabove, it is possible to form partial courses or semi-courses 21, 23 which are partially superimposed or overlapped in zone 19 in such a manner as to assure continuity of the article. The partial courses 21,23 are terminated at a point corresponding to the longitudinal opening or slit 3 by withdrawing and shearing yarns from the two partial courses 21,23 by means of the shearing device 35,36. It has become necessary to use partial courses or semi-courses 21,23 rather than continuous courses as a result of the need to shear yarns to form the edges of opening 3. If a continuous course were sheared at one edge of opening 3 on a selected needle and the beginning of the course were started up immediately on the next or within the next few needles, the free yarn would be arranged tangent to the gear rim 36, and could not be sheared. By "free yarn" is meant the yarn which is no longer taken by the the needles but which is entrained by the last needle by which it was engaged and extends between said last needle and the yarn guide. This yarn would extend between said last needle of the completed course and the first needle of the new course, if in the meantime it had not been cut, which is obtained by the arrangement described that implies the partial courses 21 and 23 with the superposed position of zone 19. Without this the free yarn as above defined could not be cut. On the other hand, partial courses or semi-courses offer the possibility of the regular shearing of the yarn at the ends with no problems.

In the zones 5, 7, 9, 11, 13 and 15 an elastic yarn is added to the usual or non-elastic yarn which forms the partial courses in at least some of the courses.

In end zones 5 and 7, for example, an elastic yarn is added in all courses of stitches to make the panty hose very strong around the ends or opening of slit 3 and to assure some elasticity. In FIGS. 5 and 6, there is illustrated a method and set-up for forming the fabric in zone 5. At both feeds A1,A2 both the usual non-elastic yarn 41 and 43 respectively and the elastic yarn 45,47 respectively are introduced with the elastic yarn being introduced to the needles at a higher level than the point at which the non-elastic yarns 41,43 are fed. In zones 5 and 7, the needles are operated to be lifted as illustrated in FIG. 5 to a height such as to pick up both yarns 41,43 and yarns 45,47. In the same courses outside zones 5 and 7, the needles are only raised to the needle paths or trajectories 49,51 so that elastic yarns 45,47, which are located at a higher level than paths 49,51 are not seized.

In FIGS. 7 and 8, the needle paths at two adjacent feeds A1,A2 and the fabric formed in zones 13 and 15 are illustrated. In zone 13, a first course 21A is obtained by introducing non-elastic yarn 53 at feed A2, while course 21B is formed with both the non-elastic yarn 51 and the elastic yarn 55 at feed A1. Thus in the partial courses in zone 13 one course includes an additional elastic yarn 55, while the next course does not. Thus one obtains the interlacing effect shown in FIG. 8.

Figure 3:
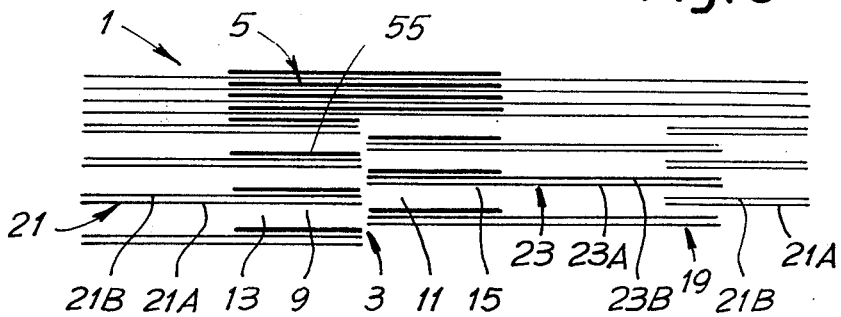
FIG. 3 is a schematic illustration showing the development of the semi-courses of fabric.

Outside of zones 13 and 15, partial course 21A includes only yarn 53 while partial course 21B includes only the non-elastic yarn 51 and elastic yarn 55 is not used. In this zone, the path of needles is as illustrated in FIG. 11 with a needle path 57 at feed A1 which is lower than the path of needles at feed A1 in FIG. 7 so that the yarn 55 is not seized. FIG. 12 illustrates the fabric in zone 17 on the outside of zone 13 and 15. In the description of FIGS. 7 and 8, yarns 51 and 53 correspond to the yarns of the partial courses 21 described earlier, while similar yarns at similar feeds are also provided to obtain pairs of courses 23A and 23B as shown in FIG. 3 on the opposite side of the opening or slit 3.

In zones 9 and 11 which are more immediately adjacent the opening or slit 3, the feed conditions remain the same as in zones 13 and 15, i.e. with yarn 53 being introduced at feed A2 and yarn 51 being introduced at feed A1 which also includes yarn 55. Looking at FIG. 9, at feed A1 the needle path is the same as that shown for feed A1 in FIG. 7, while the feed A2 is considerably different. At feed A2 in FIG. 9, there is shown a needle selection of 1:3, in which the single needles 61 are raised to such a position that the stitch is shed while the succeeding three needles 61B are raised to a position where the stitches do not clear the latch. In all cases, the needles are raised to such a level as to seize yarn 53. The fabric thus formed in zones 9 and 11 is as shown in FIG. 10 with combinations of first stitches in which there is a binding of elastic yarns and second stitches in which there is a separation of the elastic yarns as illustrated in wale 63 in FIG. 10, which is formed by the needles 61A. The interlacing obtained by the needle selection shown in FIGS. 9 and 10 makes the fabric resistant to raveling or ladders, i.e. it cannot be easily unthreaded. This is advantageous especially when considering that the yarns undergo a shearing to form the opening 3. Moreover, the fabric formed by the interlacing is very elastic which is also advantageous adjacent longitudinal opening or slit 3. Finally the aforementioned interlacing effect offers a visible tendency to roll up which improves the finish of the edges along opening 3 as well as protecting against the raveling or breakdown of stitches induced by the shearing of yarns.

In FIGS. 4 and 4A a cam shell arrangement for four feeds A1, A2, A3, and A4 is illustrated. Feeds A1 and A2 are arranged to supply the non-elastic yarn of partial courses 21 and 21B (yarns 51,53), while an additional, elastic yarn 55 is also introduced at feed A1. Feeds A3 and A4 form partial courses 23 with arrangement similar to those described hereinabove. Jacks 71 equipped with four rows of butts 71A, 71B, 71C and 71D are provided for controlling the needles. In FIG. 4A the needle zone 119 forms the zone 19 of the fabric wherein partial courses 21 and 23 are superimposed or overlapped. This zone 119 is defined by the superimposition of a first row of jack butts 71C indicated at 121 (corresponding to the semi-course of stitches 21) and of the row of jack butts 71A indicated at 123 (corresponding to the semi-course of stitches 23). The cams $x1$-$x2$-$y1$-$y2$ are suited to raise the jacks and are of the type mentioned in U.S. Pat No. 3,726,111 (FIG. 5, cam 245). Their front portion presents a step suited to raise the butts of the jacks to the tuck level, while the jacks with longer butts are raised up to a higher level, corresponding to the cleared stitch.

Butts 71C in zone 119 are of a lesser length than those of the remaining arc 121, alternated with jacks on which the butt 71C is omitted. These latter jacks are not raised by the cams $x1$ and $x2$ and thus the corresponding needles do not take the yarn at the feeds A3 and A4. At the other extremity the two rows of butts 121,123 end up on opposite sides of line 103 which corresponds to the forming of the longitudinal opening or slit 3. Needle zones 109 and 111 respectively illustrate two zones of jack butts in the rows 71A and 71C, wherein a long butt jack and three short butt jacks are alternated to obtain the selection of needles illustrated in FIG. 9. The jacks with short butts 71A and 71C, rising on the respective cams $y1$-$y2$ and $x1$-$x2$ send the corresponding needles to tuck level, while the jacks of the same zone with the longer butts 71A and 71C are raised by the same cams $y1$-$y2$ to knit level, forming with the corresponding needles 61A (FIG. 9) rows of stitches like 63 in FIG. 10. So arranged the jack butts in zones 109 and 111 form the interlacing pattern illustrated in FIG. 10 in zones 9 and 11 immediately adjacent opening or slit 3. A jack zone 113 of high butts is positioned along the row of butts 71D to insure the raising of needles on a cam $z$-1 for seizing elastic yarns (such as yarn 55) in forming the fabric zones 9 and 13. A similar jack zone of high butts 115 is provided along the rows of butts 71B for insuring raising of the needles on a cam $z$-2 to seize the elastic yarn in forming zones 11 and 15. The needle zones and jack butt arrangement for the forming of fabric zones 5 and 7 are not illustrated, however the set-up provides for lifting the needles to the higher trajectory to seize the elastic yarn 45 by gradually varying the arc of needles lifted to the higher elevation in successive courses, as disclosed in U.S. Pat. No. 3,726,111. Thus a profiling of the zones 5 and 7 is accomplished.

The method described hereinabove forms a panty hose of the type described directly on a circular hosiery knitting machine of conventional type. Such a machine can be set-up by a person of ordinary skill in the art to select needles, feed yarns, form the waist opening and the associated band of elastic surrounding the edges of said slit. If desired, the panty hose at each end may be completed directly on the knitting machine by utilizing the conventional toe closing techniques.

It is obvious that various changes and modifications may be made to the embodiment described hereinabove without departing from the scope of the invention, which is to be determined by the following claims.

What is claimed is:

1. A knit construction for the waist portion of a one-piece panty hose comprising a longitudinally extending waist opening, a reinforced band of fabric surrounding said opening and comprising successive courses each of which is a partial course extending between an edge of said opening and a second position arcuately spaced around the circumference of said panty hose from said opening, said reinforced band including an auxiliary reinforcing yarn in selected courses, said reinforced band also including an inner edge zone immediately adjacent the edges of said opening in which selected stitches of selected courses are combined with the corresponding stitches of successive courses, and wherein said partial courses extend alternately around the circumference from said opening first in one arcuate direction and then in the opposite arcuate direction, the ends of said partial courses being overlapped at said second position.

* * * * *